US010670003B1

(12) United States Patent
Wang et al.

(10) Patent No.: US 10,670,003 B1
(45) Date of Patent: Jun. 2, 2020

(54) TILT LINKAGE FOR VARIABLE STROKE PUMP

(71) Applicant: CW Holdings Ltd., Acheson, Alberta (CA)

(72) Inventors: Jianke Wang, Conroe, TX (US); Zhe Huangpu, Humble, TX (US); Milton Anderson, Houston, TX (US); Xiaonan Zhai, Houston, TX (US); Leslie Wise, Acheson (CA)

(73) Assignee: CW HOLDINGS LTD., Acheson (CA)

( * ) Notice: Subject to any disclaimer, the term of this patent is extended or adjusted under 35 U.S.C. 154(b) by 0 days.

(21) Appl. No.: 16/662,513

(22) Filed: Oct. 24, 2019

(51) Int. Cl.
*F04B 27/10* (2006.01)
*F01B 3/00* (2006.01)

(52) U.S. Cl.
CPC ..... *F04B 27/1063* (2013.01); *F01B 3/005* (2013.01)

(58) Field of Classification Search
CPC .. F04B 1/29; F04B 1/295; F04B 1/146; F04B 1/148; F04B 27/1063; F04B 27/1072; F04B 27/18
USPC ..... 91/506
See application file for complete search history.

(56) References Cited

U.S. PATENT DOCUMENTS 2,956,845 A 10/1960 Wahlmark
3,009,422 A 11/1961 Davis
3,223,042 A 12/1965 Thresher
3,319,874 A 5/1967 Welsh et al.
3,861,829 A * 1/1975 Roberts ..... F04B 27/10 417/53
4,784,045 A 11/1988 Terauchi
5,252,032 A * 10/1993 Iwanami ..... F04B 27/18 417/222.1
5,836,748 A * 11/1998 Kawaguchi ..... F04B 27/109 417/222.2
6,957,604 B1 * 10/2005 Tiedemann ..... F04B 1/295 417/222.1
9,046,089 B2 * 6/2015 Tagami ..... F04B 27/0895
9,429,147 B2 * 8/2016 Suzuki ..... F04B 1/295

FOREIGN PATENT DOCUMENTS

WO WO 2019/00519 A1 1/2019

OTHER PUBLICATIONS

International Search Report and Written Opinion dated Sep. 13, 2018 in PCT/US18/39049, filed Jun. 22, 2018.

* cited by examiner

*Primary Examiner* — Michael Leslie
(74) *Attorney, Agent, or Firm* — Hauptman Ham, LLP

(57) ABSTRACT

A variable stroke high pressure pump is disclosed. The pump uses a wobble plate design with dynamically variable tilt to provide continuous adjustment of pump stroke length and output. Dynamically variable tilt is accomplished using a linearly actuated tilt thruster rotationally coupled to the drive shaft to maintain a selected tilt of the wobble plate through the rotation of the wobble plate.

27 Claims, 14 Drawing Sheets

TILT LINKAGE FOR VARIABLE STROKE PUMP

FIELD

Embodiments described herein relate to high pressure pumps used in oil and gas service.

BACKGROUND

Production of oil and gas is a trillion-dollar industry. Producers continually seek ways to increase the speed and flexibility, and lower the cost of, production apparatus for onshore and offshore oil and gas production. Equipment downtime is costly, so efficient repair and replacement of equipment in the field is valuable. High pressure pumps are routinely used in oil and gas service to pump various fluids, such as processing fluids, hydraulic fracturing fluids, and flush fluids through hydrocarbon reservoirs. Failure of such a pump shuts down production.

Typically, high pressure pumps are switched on and off when needed. Such power cycling reduces the lifetime of the pump. Additionally, different pumps are typically used for different service requiring different pressure or flow rate. High pressure pumps capable of producing varying flow rates and pressures and capable of idling without being shut off, are needed in the industry.

SUMMARY

Embodiments described herein provide a pump, comprising a drive shaft coupled to a drive; a wobble plate attached to the drive shaft by a swivel mount; a plurality of displacement rods, each having a first end and a second end, with the first end of each displacement rod disposed against a first surface of the wobble plate and the second end of each displacement rod connected with a plunger; and a tilt actuator assembly disposed around the drive shaft, the tilt actuator assembly comprising a slider having an interior surface with a slot formed therein and a thruster coupled to the slider and extending toward a second surface of the wobble plate opposite the first surface, the tilt actuator assembly further comprising a key extending radially outward from the drive shaft and mated with the slot and a linear actuator slidably disposed against the slider.

A pump, comprising a drive shaft coupled to a drive; a wobble plate attached to the drive shaft by a ball-shaped swivel mount with a wobble plate key extending radially inward from the wobble plate to the swivel mount; a plurality of displacement rods, each having a first end and a second end, with the first end of each displacement rod disposed against a first surface of the wobble plate and the second end of each displacement rod connected with a plunger; a thrust bearing between each displacement rod and the wobble plate; a tilt actuator assembly disposed around the drive shaft, the tilt actuator assembly comprising a slider with a slot formed therein and a thruster coupled to the slider and extending toward a second surface of the wobble plate opposite the first surface; and a key extending radially outward from the drive shaft and mated with the slot.

Other embodiments provide a pump, comprising a drive shaft coupled to a drive; a wobble plate attached to the drive shaft by a ball-shaped swivel mount with a wobble plate key extending radially inward from the wobble plate to the swivel mount; a plurality of displacement rods, each having a first end and a second end, with the first end of each displacement rod disposed against a first surface of the wobble plate and the second end of each displacement rod connected with a plunger; a thrust bearing between each displacement rod and the wobble plate; a tilt actuator assembly disposed around the drive shaft, the tilt actuator assembly comprising a slider with an interior surface that has a slot formed therein and a thruster coupled to an exterior surface of the slider and extending toward a second surface of the wobble plate opposite the first surface, the slider attached to the drive shaft by a guide ring; a key extending radially outward from the drive shaft and the guide ring, and mated with the slot; and a linear actuator slidably disposed within the drive shaft and coupled to the slider and to a hydraulic member located at a fluid end of the pump.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical descriptors have been used, where possible, to designate identical elements that are common to the figures. It is contemplated that elements disclosed in one embodiment may be beneficially utilized on other embodiments without specific recitation.

DETAILED DESCRIPTION

Figure 1:
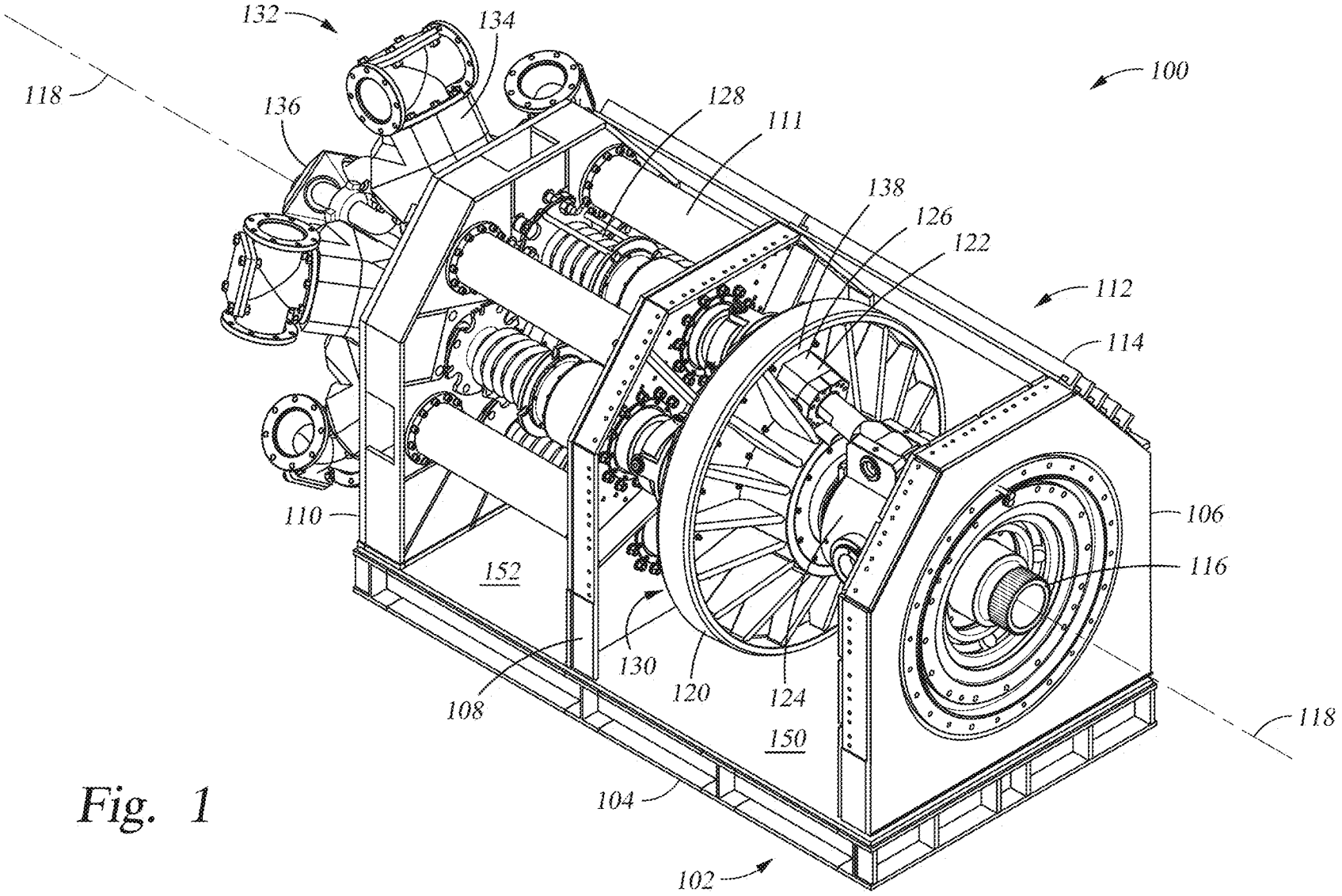
FIG. 1 is an isometric view of a variable stroke pump according to one embodiment.

FIG. 1 shows an external isometric view of an assembled variable stroke reciprocating pump 100. The view of FIG. 1 is taken from the power end of the pump 100. The pump 100 comprises a frame 102, which comprises a base 104, a drive plate 106, a bearing plate 108 and a fluid end plate 110, each plate attached to the base 104. A plurality of stabilizers 111 are disposed between the bearing plate 108 and the fluid end plate 110 to provide stability of the pump 100 at the fluid end thereof. Some of the tension rods 111 are removed from the view of FIG. 1 for ease of explanation. The base 104 and the plates 106, 108, and 110 provide stability and support for the operative elements of the pump 100. The pump has a power section 150 between the drive plate 106 and the bearing plate 108, and a displacement section 152 between the bearing plate 108 and the fluid end plate 110. A case 112 may be disposed around the outside of the plates 106, 108, and 110 to enclose the operative elements of the pump 100. The case 112 may feature thermal features 114 for managing temperature of pump internal components.

The pump 100 has a drive shaft 116 disposed along a central axis 118 of the pump 100. A wobble plate 120 is disposed around the drive shaft 116 and rotationally coupled to the drive shaft 116. The wobble plate 120 is tilted to provide reciprocating motion for driving the pumping mechanism of the pump 100. A thruster assembly 122 is attached to a slider 124 disposed around the drive shaft, and the thruster assembly 122 extends toward the wobble plate 120, contacting the wobble plate 120 at a contact location 126. The slider 124, and thruster assembly 122, are both rotationally coupled to the drive shaft 116. The thruster assembly 122 is actuated along the axis 118 of the pump 100 to move the contact location 126 in a direction nearly parallel to the axis 118 of the pump 100. Movement of the contact location 126 adjusts a tilt angle of the wobble plate 120, and the pump 100 is configured such that such adjustment can be performed while the pump 100 is operating.

Figure 7A:
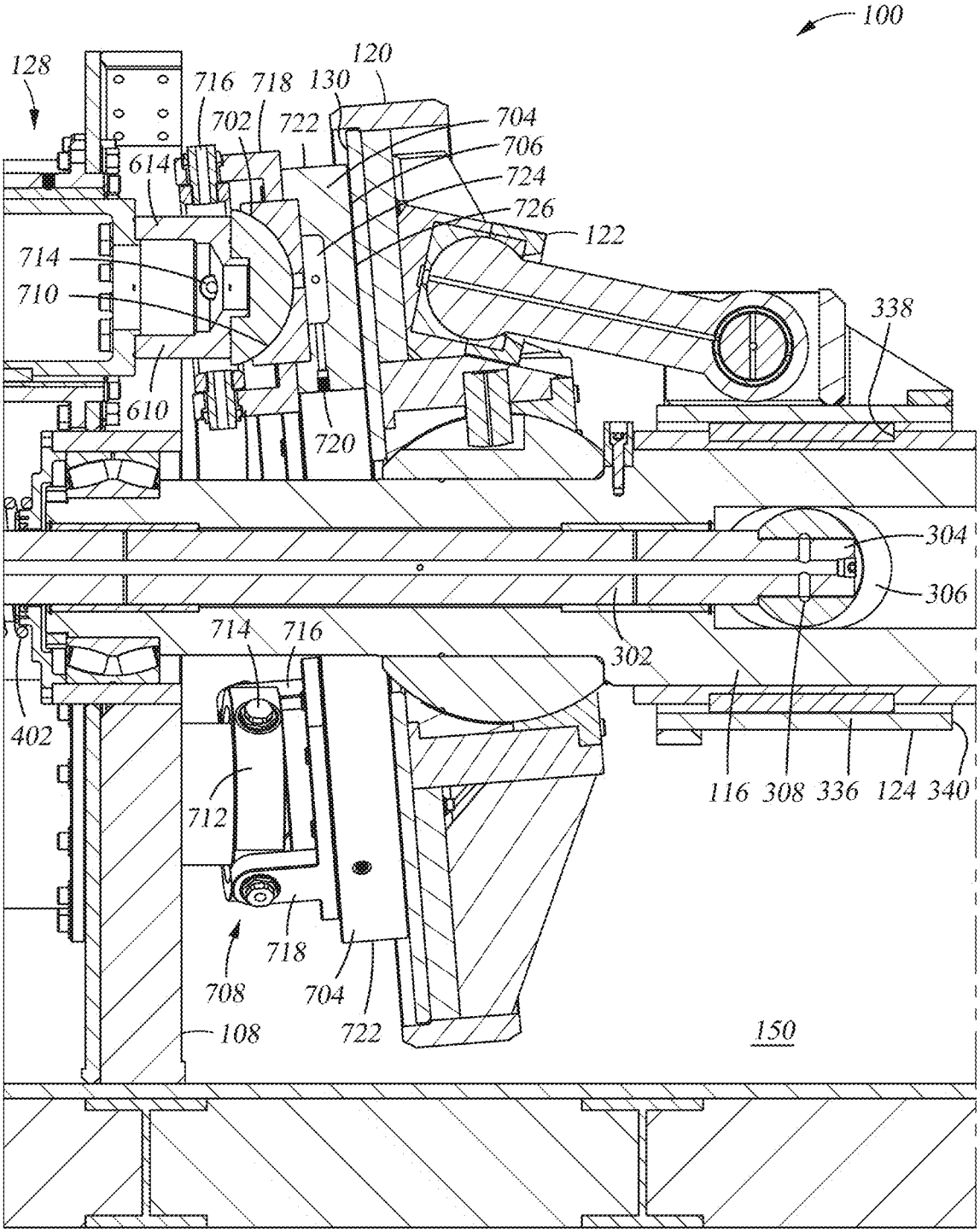
FIG. 7A is a different close-up view of the cross-section of FIG. 4.

A plurality of displacement rods 128 are disposed through the bearing plate 108, and contact the wobble plate 120 at a first surface 130 thereof (also shown in FIG. 7A). The thruster assembly 122 contacts the wobble plate 120 at a second surface 138 thereof opposite from the first surface 130. Each displacement rod 128 ends with a plunger (not shown) disposed in a chamber (not shown) formed by a portion of the fluid end plate 110 and a fluid end assembly 132 coupled to the fluid end plate 110. The fluid end assembly 132 comprises a plurality of module assemblies 134, each module assembly 134 coupled to the fluid end plate 110. Each module assembly 134 cooperatively defines a chamber, with the fluid end plate 110, in which the plunger of each displacement rod 128 reciprocates to pump fluid through the module assembly 134. Each module assembly 134 has a suction valve (not shown) disposed in a conduit (not shown) oriented radially outward from the axis 118 of the pump 100 and a discharge valve (not shown) disposed in a conduit oriented parallel to the axis 118. A discharge manifold 136 connects the discharge valve conduits of the module assemblies 134 together to a pump outlet.

Figure 2:
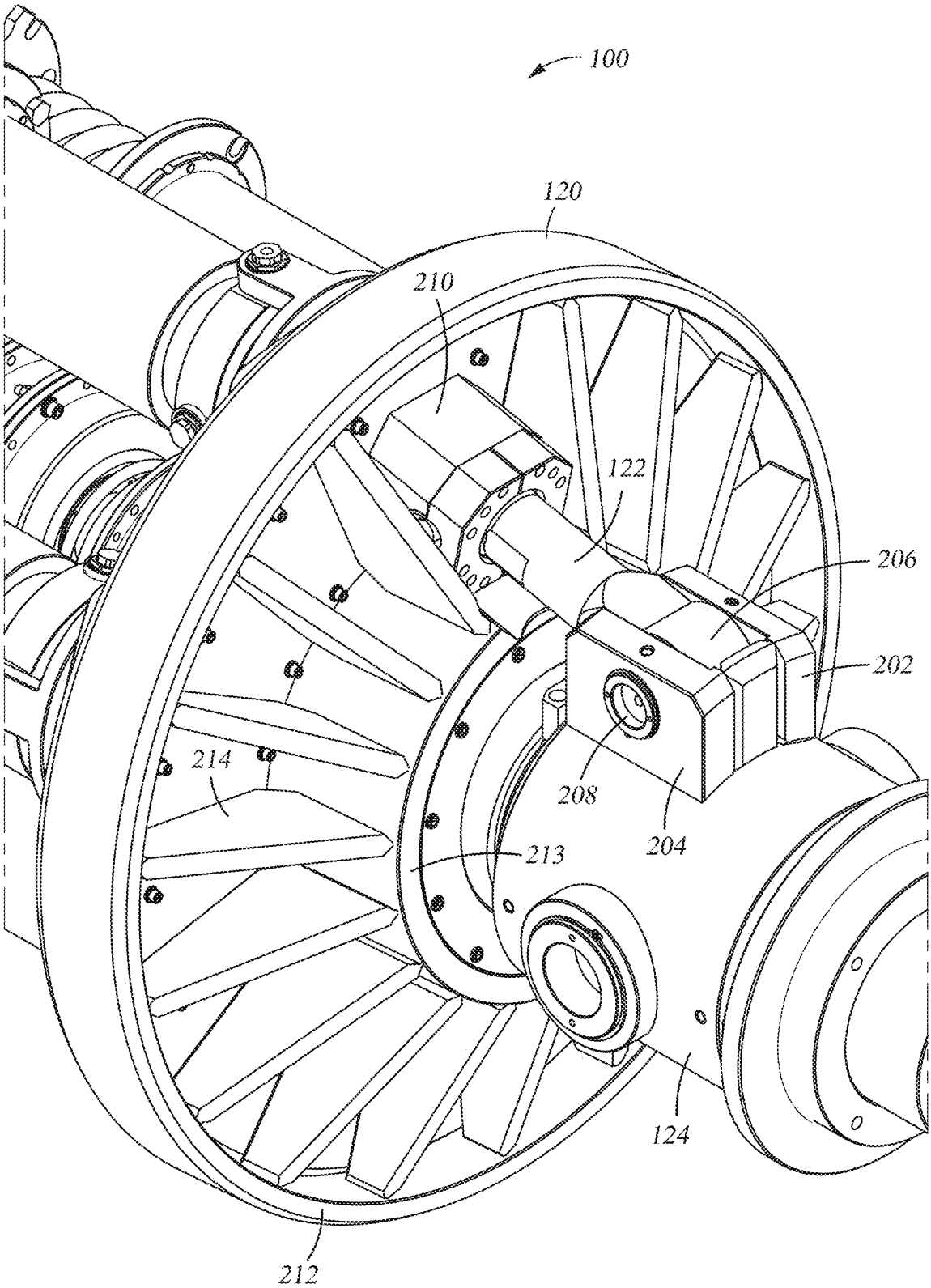
FIG. 2 is a close-up view of a portion of the pump of FIG. 1.

FIG. 2 is a close-up view of the power end of the pump 100 of FIG. 1. The thruster assembly 122 is coupled to the slider 124 by an axle block 202. The slider 124 is a cylindrical object positioned generally co-axially with the axis 118 of the pump. The axle block 202 comprises two parallel walls 204 extending outward from the slider 124 and a connector 206 that is attached, or integral with, the thruster assembly 122 disposed between the walls 204 and fastened into the axle block 202 by an axle 208 extending through the walls 204 and the connector 206. The axle 208 provides rotational freedom for the thruster assembly 122 to change angular position with respect to the axis 118 of the pump 100 as the angle of the wobble plate 120 changes.

The thruster assembly 122 contacts the second surface 138 at a rotational thrust bearing 210 that allows rotational freedom for the thruster assembly 122 to change angular position with respect to the second surface 138 of the wobble plate 120. The wobble plate, here, is a plate with a cylindrical rim 212, a cylindrical hub 213 that accommodates the drive shaft 116 (FIG. 1) and a webbing 214 extending from the hub 213 to the rim 212. The webbing 214 and the rim 212 increase stiffness of the wobble plate 120 under the mechanical loads of the pump 100.

Figure 3:
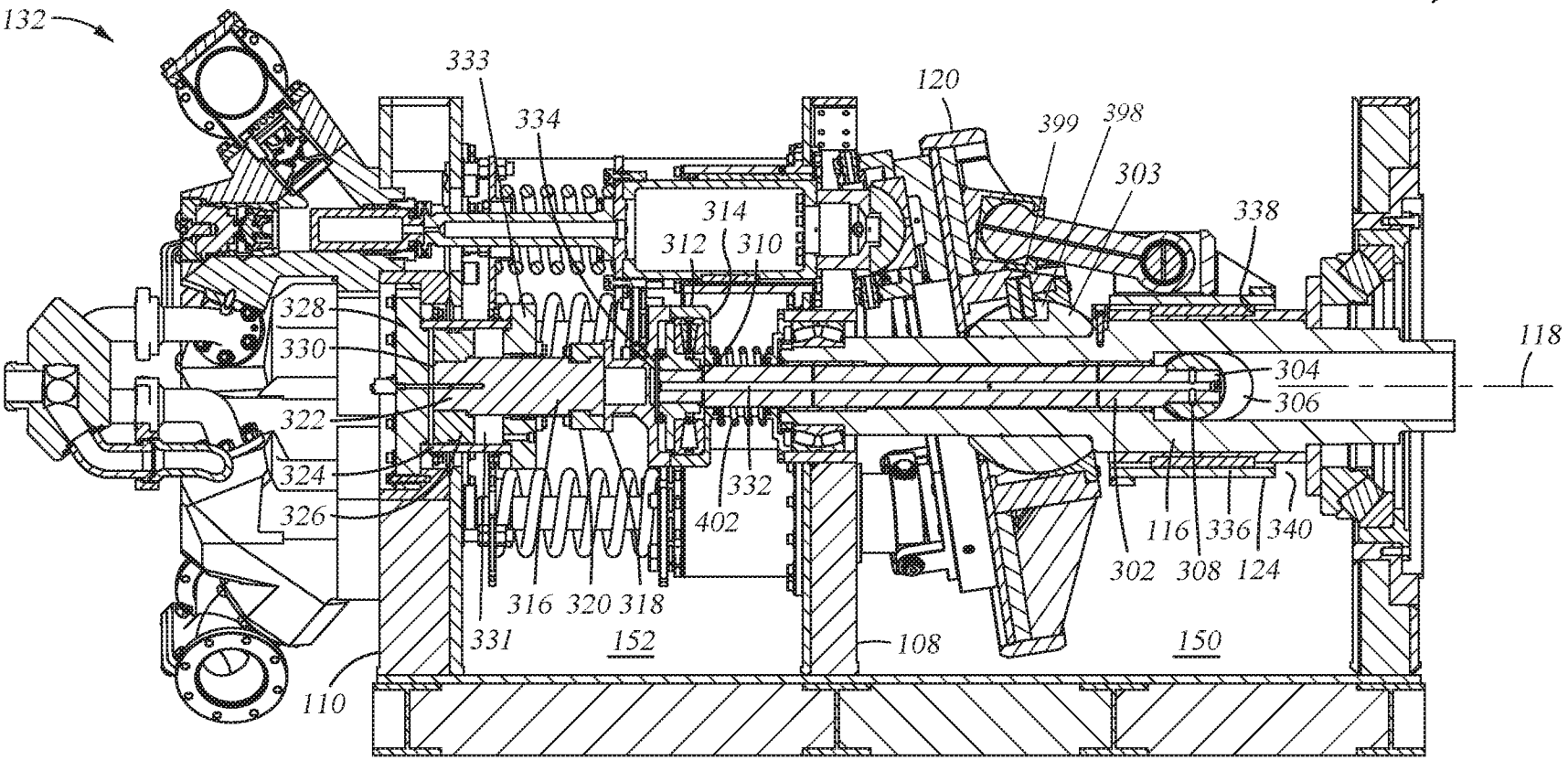
FIG. 3 is a cross-sectional view of the pump of FIG. 1.

FIG. 3 is a cross-sectional view of the pump 100 taken vertically from the view of FIG. 1 through the axis 118 of the pump 100. A linear actuator 302 is disposed in an axial bore within the drive shaft 116. The linear actuator 302 is thus co-axial with the drive shaft 116. A first end 304 of the linear actuator 302 is disposed at a cross-bore 306 of the drive shaft 116. A wrist pin 308 is coupled to the first end 304 of the linear actuator 302, and extends laterally through the cross-bore 306 to couple to the slider 124 at opposite lateral locations outside the outer wall of the drive shaft 116. The cross-bore 306 is elongated in the axial direction of the drive shaft 116 to provide freedom of movement of the first end 304 and wrist pin 308 of the linear actuator 302 in the axial direction within the chamber 306. The linear actuator 302 rotates with the drive shaft 116 and moves axially within the drive shaft 116 to position the slider 124 and adjust the tilt angle of the wobble plate 120. The wobble plate is attached to the drive shaft by a swivel mount 303. The swivel mount has a key slot 398 parallel to the drive shaft. A removable wobble plate key 399 fits within the key slot 398. Here, the maximum displacement of the linear actuator 302, and thus the maximum elongation of the cross-bore 306, is determined by the maximum tilt desired for the wobble plate 120.

The linear actuator 302 has a second end 310 that extends to a rotary bearing 312. The linear actuator 302 extends into a first side 314 of the rotary bearing 312. A hydraulic member 316 is disposed against a second side 318 of the rotary bearing 312, opposite from the first side 314, to provide force to move the rotary bearing 312 in the axial direction of the pump 100, and thus to displace the linear actuator 302. A rod end 320 of the hydraulic member 316 contacts the rotary bearing 312, while a piston end 322 of the hydraulic member 316, opposite from the rod end 320, is disposed within a cylinder 324. A piston 326 is coupled to the piston end 322. An end plate 328 is attached to the fluid end plate 110 and is disposed against an end of the cylinder 324 to seal the end of the cylinder 324. The end plate 328 and the piston end 322 cooperatively define a retraction chamber 330 within the cylinder 324. Hydraulic fluid is pressured into the retraction chamber 330 to displace the hydraulic member 316 toward the wobble plate 120, which in turn displaces the rotary bearing 312 and the linear actuator 302 in the axial direction to retract the wobble plate 120 toward a more perpendicular orientation with respect to the drive shaft 116. Opposite the piston 326 from the retraction chamber 330 is an extension chamber 331, between the piston 326 and a piston plate 333. Hydraulic fluid is pressured into the extension chamber 331 to displace the hydraulic member 316 away from the wobble plate 120, which displaces the rotary bearing 312 and the linear actuator 302 in the axial direction to extend the wobble plate 120 toward a more angled orientation with respect to the drive shaft 116. The hydraulic member 316 does not rotate with the drive shaft. Methods other than hydraulic displacement, for example gas displacement or electromechanical displacement, can be used to displace the rotary bearing 312 and the linear actuator 302.

Figure 12:
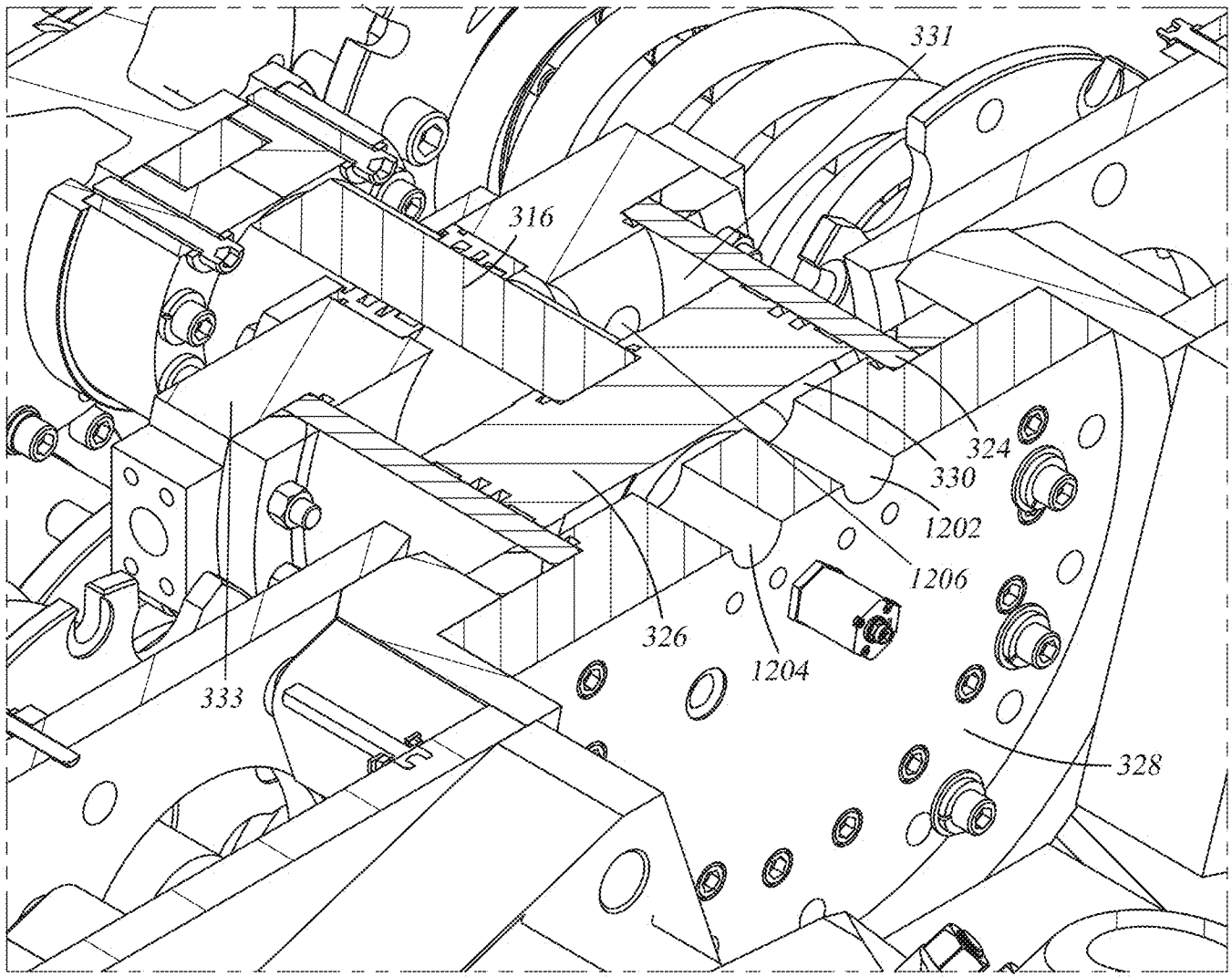
FIG. 12 is a close-up view of a different cross-section of the pump of FIG. 1.

FIG. 12 is a close-up view of a different cross-section of the pump 100 of FIG. 1. The section plane of FIG. 12 is in a longitudinal direction of the pump 100 and is perpendicular to the section plane of FIG. 3. The section plane of FIG. 12 is also offset from the axis 118 (FIG. 1) of the pump 100.

So, the section plane of FIG. 12 is parallel to the axis 118, offset from the axis 118, and perpendicular to the section plane of FIG. 3. FIG. 12 shows the end plate 328 in close-up. Two retraction ports 1202 and 1204 are formed through the end plate 328 to provide fluid communication to the retraction chamber 330. The ports 1202 and 1204 are used to flow hydraulic fluid to and from the retraction chamber 330. Here, the ports 1202 and 1204 are disposed through the end plate 328 with identical radial offset from the plate center and along a line spaced apart from the plate center. The ports 1202 and 1204 may be disposed at any convenient location of the end plate 328 for accessing the retraction chamber 330, but must in any event be close enough to the plate center to open into the retraction chamber 330. Here, each port is located a radial distance from the plate center that is about ⅓ the radius of the end plate 328.

An extension port 1206 is formed through the piston plate 333 to provide fluid communication to the extension chamber 331 such that hydraulic fluid can be flowed into and out of the extension chamber 331. The extension port 1206 can be provided at any convenient location, and more than one extension port 1206 can be used. Where other methods of displacement are used, the ports 1202, 1204, and 1206 may be omitted, and other enabling features, such as attachments, conduits, or ports, may be included.

Figure 4:
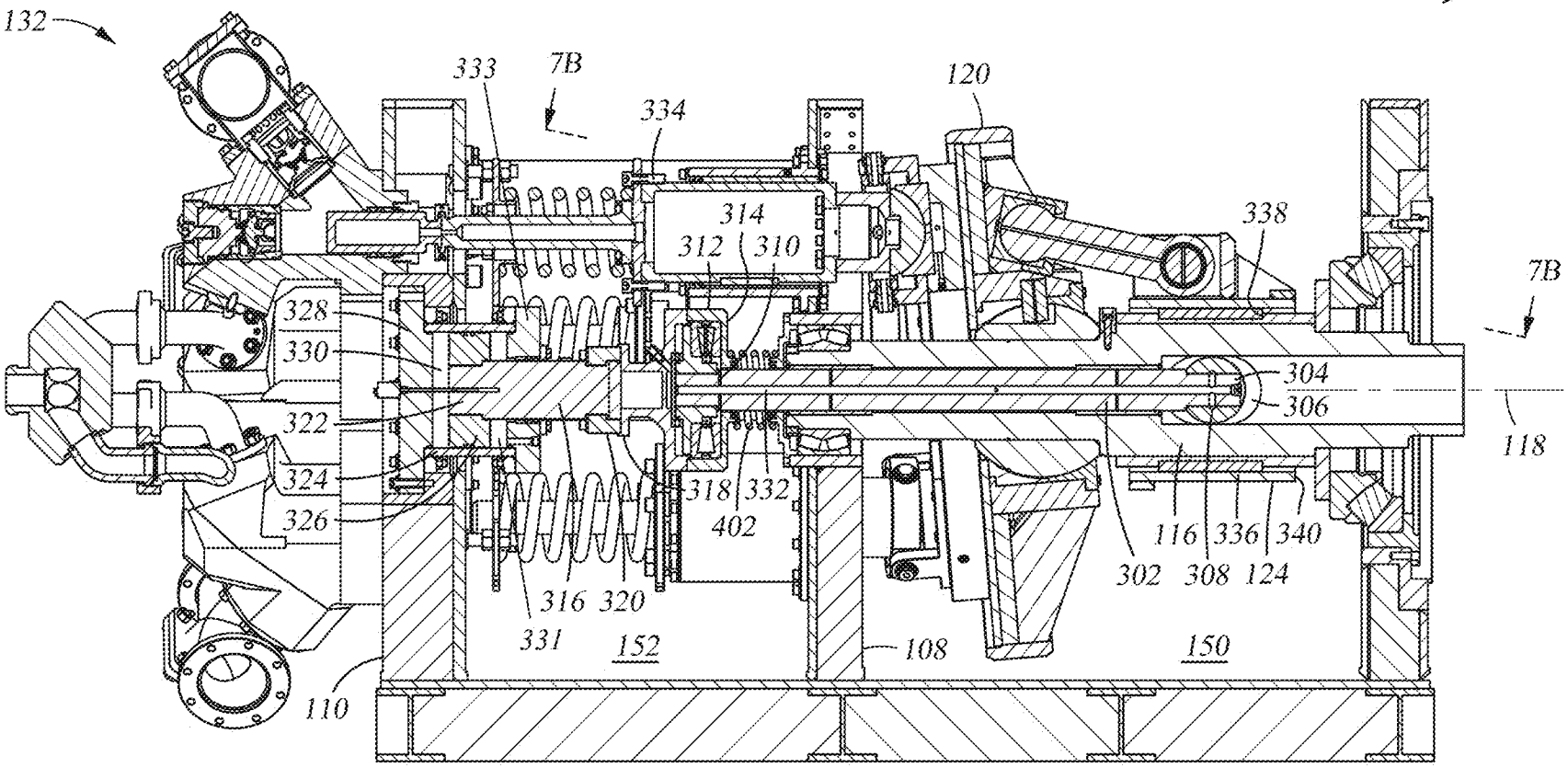
FIG. 4 is another cross-sectional view of the pump of FIG. 1 in a different operational mode.

FIG. 4 is another cross-sectional view of the pump 100 of FIG. 1 in a different operational configuration. Specifically, in FIG. 4, the hydraulic member 316 is shown displaced in the axial direction. The retraction chamber 330 is larger in FIG. 4 than in FIG. 3 indicating the displacement. The first end 304 of the linear actuator 302 is also positioned in a more central location of the cross-bore 306 than in FIG. 3. By operation of the hydraulic mechanism comprising the hydraulic member 316 cylinder 324 and end plate 328, the rotary bearing 312 and the linear actuator 302 are displaced axially. The rotary bearing 312 allows rotation of the linear actuator 302 with the drive shaft 116 so that the linear actuator 302 is displaced within the drive shaft. The slider 124 is displaced axially by the linear actuator 302, generating a retracting force on the thruster assembly 122, which is coupled to the wobble plate 120 at a location spaced radially from a center of the wobble plate 120. The retracting force reduces tilt angle of the wobble plate 120, bringing the wobble plate 120 into more vertical alignment closer to a perpendicular relationship with the drive shaft 116 (compare FIG. 3 with FIG. 4).

A spring 402 biases the rotary bearing 312 toward the fluid end 132 of the pump 100. The spring 402 generates a reaction force that opposes the hydraulic force of the hydraulic member 316. When the hydraulic force of the hydraulic member 316 is reduced below the reaction force of the spring 402, or when the hydraulic force reverses in direction by operation of the extension chamber 331, the rotary bearing 312 is displaced toward the fluid end 132. Movement of the rotary bearing 312, translated through the linear actuator 302 and the pin 308, moves the slider 124 toward the fluid end 132 and increases the tilt angle of the wobble plate 120. The interaction of the rotary bearing 312 and the hydraulic member 316 allows tilt angle of the wobble plate 120 to be adjusted while the pump 100 is in operation. The spring 402 is disposed around the linear actuator 302 between the rotary bearing 312 and the bearing plate 108, which provides support for the spring 402 to generate the reaction force. The linear actuator 302 extends through the bearing plate 108 to the rotary bearing 312, which is located in the displacement section 152 of the pump.

Referring again to FIG. 3, the linear actuator 302 includes a lubricant conduit 332 disposed along a central axis of the linear actuator 302. The lubricant conduit 332 extends substantially from the first end 304 to the second end 310 of the linear actuator 302. A lubricant port 334 couples to the rotary bearing 312, allowing for injection of lubricant into the lubricant conduit 332. Lubricant passes through the lubricant conduit 332 to the first end 304 of the linear actuator 302 and into the lubricant spaces within the drive shaft 116.

The slider 124 is constrained to rotate with the drive shaft 116 by operation of a key 336. The key 336 fits in a slot (not shown in FIG. 3) in the slider 124 and engages a recess 338 formed in a guide ring 340 that is fused to the drive shaft 116. The key 336 extends in the axial direction of the pump 100 and constrains the slider 124 to the guide ring 340, forcing the slider 124 to rotate with the drive shaft 116. In this manner, the force point for adjusting tilt angle of the wobble plate 120 is always the same, and the thruster assembly 122 and slider 124 provide support for the wobble plate 120 to deliver reciprocating pumping force to the displacement rods 128.

Figure 5:
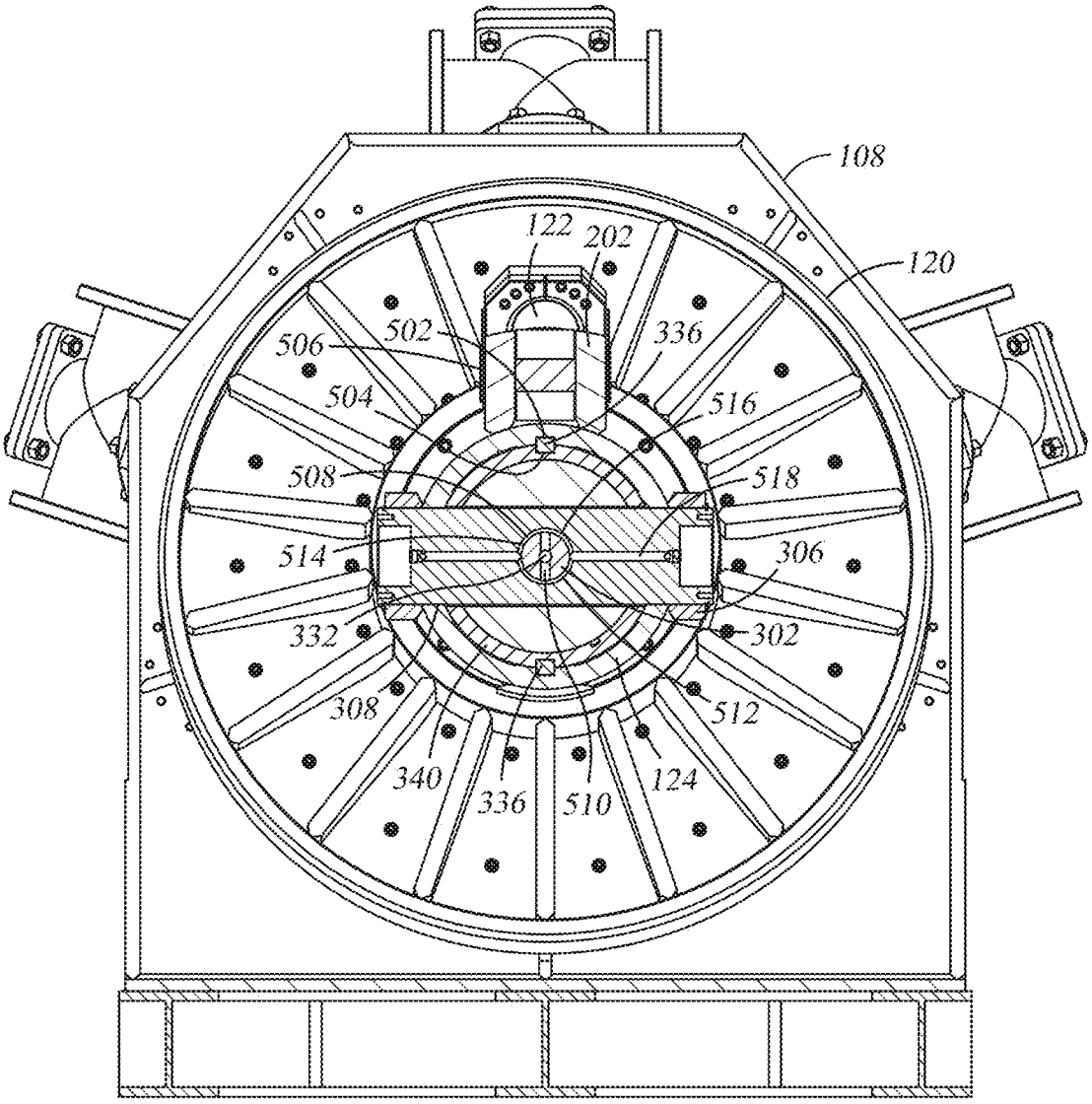
FIG. 5 is a different cross-sectional view of the pump of FIG. 1.

FIG. 5 is a cross-sectional view of the pump 100 of FIG. 1 taken along a section plane perpendicular to the section plane of FIGS. 3 and 4 and along an axis of the wrist pin 308. Two keys 336 couple the slider 124 to the guide ring 340. As noted above, each key engages with a first slot 502 in the slider 124 and a second slot 504 in the guide ring 340. The first slot 502 and second slot 504 are aligned such that the keys 336 transmit rotational force from the guide ring 340 to the slider 124. The slider 124, keys 336, and wrist pin 308 together form a cross-head assembly 506 that couples the wobble plate 120 to the linear actuator 302. The two keys 336 are positioned at opposite sides of the cross-head assembly 506 in alignment with the thruster assembly 122. Here, two keys 336 are used, but any convenient number of keys can be used. Generally the keys 336 are uniformly spaced around the circumference of the slider 124.

The wrist pin 308 has a passage 508 into which the linear actuator 302 is inserted to couple the linear actuator 302 to the wrist pin 308. The passage 508 is formed through the wrist pin 308 in a direction transverse to the axis of the wrist pin 308. The linear actuator 302 has at least one lateral lubricant conduit 510 extending radially outward from the axial lubricant conduit 332. Here, there are two lateral lubricant conduits 510, but any number could be used. The lateral lubricant conduit 510 provides fluid communication between the axial lubricant conduit 332 and an annular gap 512 between an outer surface 514 of the linear actuator 302 and an inner surface 516 of the passage 508. Lubricant can flow from the axial lubricant conduit 332 through the lateral lubricant conduit 510 to the annular gap 512. The wrist pin 308 has an axial lubricant passage 518 that provides a flow pathway for lubricant to fill the lubricant spaces within the cross-head assembly 506.

Figure 6A:
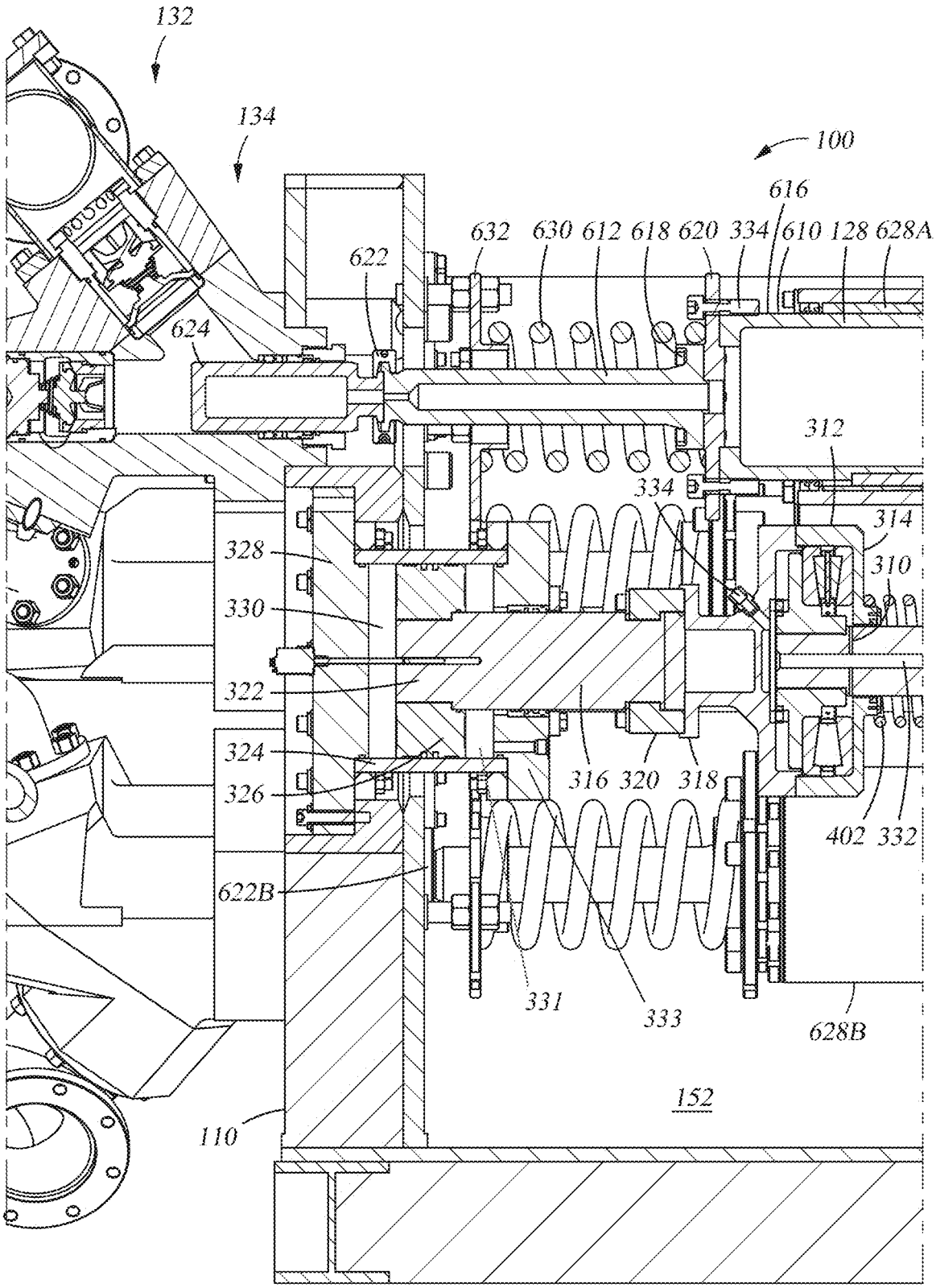
FIG. 6A is a close-up view of the cross-section of FIG. 4.

FIG. 6A is a close-up view of the cross-section of FIG. 4. FIG. 6A generally shows the displacement zone 152 of the pump 100 in cross-section. The displacement rods 128 each have a first section 610 and a second section 612. A first end 614 of the first section 610 extends through the bearing plate 108 (as shown in FIG. 7A). A second end 616 of the first section 610, opposite from the first end 614, is coupled to a first end 618 of the second section 612 by an attachment plate 620. A second end 622 of the second section 612 extends to the fluid end plate 110, and reciprocates into and out of the fluid end plate 110. The reciprocation of the displacement rods 128 can be seen by comparing two displacement rods 128 visible in the view of FIG. 6A. A first displacement rod 628A is in a fully extended position while a second displacement rod 628B is retracted. In this view, a second end 622B of the second displacement rod 628B can be seen outside the fluid end plate 110 and within the displacement zone 152. The difference in position of the first and second displacement rods 628A and 628B illustrates the length of the pump stroke set by the tilt angle of the wobble plate (FIG. 4). As the tilt angle is adjusted, the length of the pump stroke changes, so the difference between the extended and retracted positions of the displacement rods 128 correspondingly changes.

A plunger 624 is coupled to the second end 622 of each displacement rod 128. The plunger 624 extends through the fluid end plate 110 into a corresponding module assembly 134 to propel fluid through the discharge valve of the module assembly 134 during the power stroke, when the displacement rod 128 is extended, and to draw fluid through the suction valve of the module assembly 134 into the module assembly 134 during the suction stroke, when the displacement rod 128 is retracted. The sections 610 and 612 of the displacement rod 128, and the plunger 624, are all hollow in this view to reduce overall weight of the pump 100, but these components may be solid.

A flexible force resistant member 630, in this case a spring, is disposed around the second section 612 of each displacement rod 128. The force resistant member 630 is situated against the attachment plate 620 at a first end thereof and against a collar 632 attached to the fluid end plate 110 at a second end thereof. The force resistant member 630 applies a retracting force to bias the displacement rods 128 toward a retracted position so that when the wobble plate rotates to release the power stroke of the displacement rod 128, the force resistant member 630 applies retracting force to the attachment plate 620, thus moving the displacement rod 128 toward the retracted position and accomplishing the suction stroke of the displacement rod 128. As the wobble plate further rotates to apply the power stroke of the displacement rod 128, the force resistant member 630 is compressed and absorbs mechanical energy to be released during the suction stroke.

Figure 6B:
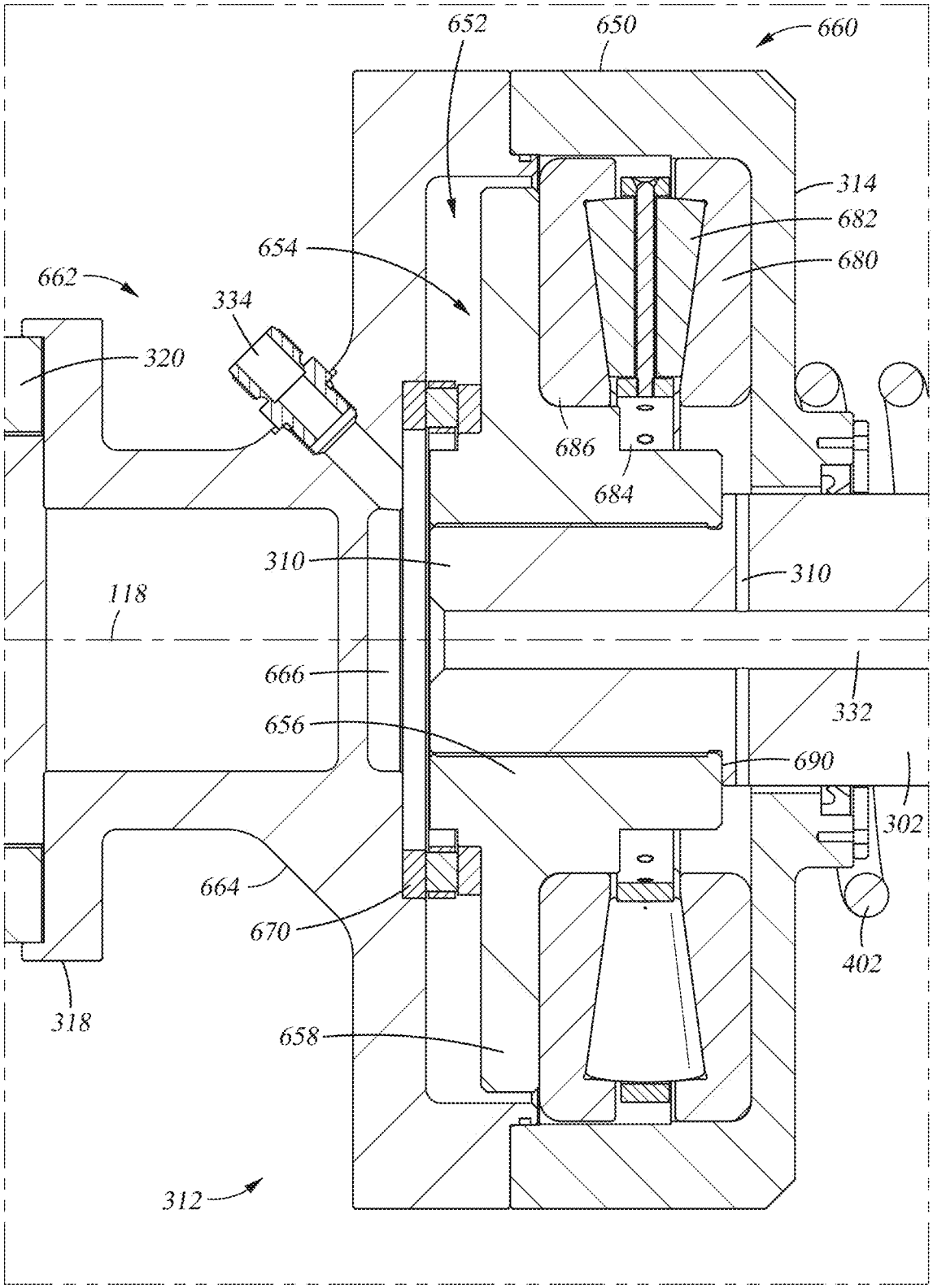
FIG. 6B is a close-up cross-sectional view of a rotary bearing used in the pump of FIG. 1.

FIG. 6B is a close-up cross-sectional view of the rotary bearing 312. The rotary bearing 312 includes an enclosure 650 that defines an interior 652. The second end 310 of the linear actuator 302 extends into the interior 652, and is rotatable within the enclosure 650, which does not rotate. The rotary bearing 312 includes a coupling plate 654 attached to the second end 310 of the linear actuator 302. The coupling plate 654 is a disk-like member with a hub portion 656 that fits around the second end 310 and a flange portion 658 that extends radially outward from the hub portion 656 in a lateral direction relative to the axis 118 toward the enclosure 650.

The enclosure 650 has two sections. A first section 660 has dimension selected to contain the coupling plate 654, and thus has a radial extent substantially larger than an outer radius of the linear actuator 302. The first section 660 includes the first side 314. A second section 662 has a radial extent smaller than that of the first section 660. The first section 660 and the second section 662 are joined by a shoulder 664. The lubricant port 334 is formed through the shoulder 664 and fluidly couples to a lubricant plenum 666 formed within the shoulder 664 adjacent to the second end 310 of the linear actuator 302. The lubricant conduit 332 fluidly couples to the lubricant plenum 666.

The shoulder 664 has a recess 668 that is co-axial with the axis 118 and faces the second end 310 of the linear actuator 302. A first thrust bearing 670 is disposed in the recess 668. The first thrust bearing 670 is thus supported by the shoulder 664. The first thrust bearing 670 comprises a plurality of rings with one or more rollers to provide differential rotary motion of the rings. Thus, a first ring 672 of the first thrust bearing 670 contacts the shoulder 664 and does not rotate. A second ring 674 of the first thrust bearing 670 contacts the flange portion 658 at a location where the flange portion 658 joins the hub portion 656, and is thus rotatable with the linear actuator 302 and the drive shaft 116. A third ring 676 of the first thrust bearing 670 houses at least three rollers (not shown) that couple the first and second rings 672 and 674. The first thrust bearing 670 participates in decoupling axial thrust of the hydraulic member 316 from rotary motion of the linear actuator 302.

A second thrust bearing 680 is located between the second side 314 and the flange portion 658. Thus, the flange portion 658 of the coupling plate 654 extends between two thrust bearings within the rotary bearing 312. The first thrust bearing 670 contacts the coupling plate 654 on a first side thereof and the second thrust bearing 680 contacts the coupling plate 654 on a second side thereof opposite from the first side. Here, the flange portion 658 of the coupling plate 654 is sandwiched between the first and second thrust bearings 670 and 680. The second thrust bearing 680 comprises a plurality of frustoconical rollers 682, each coupled to a hub ring 684 by an axle 686. A pair of rings 688 capture the rollers 682 and participate in distributing axial thrust of the hydraulic member 316 throughout the structure of the rotary bearing 312. In this case, an end of the hub portion 656 of the coupling plate 654 extends through the hub ring 684 to contact a shoulder 690 of the linear actuator 302.

FIG. 7A is a different close-up view of the cross-section of FIG. 4. The view of FIG. 7A generally focuses on the power section 150 of the pump 100. The first end 610 of each displacement rod 128 has a spherical end cap 702 that couples with a tilt pad bearing 704. The tilt pad bearing 704 abuts the first surface 130 of the wobble plate 120 at a slip face 706. The tilt pad bearing 704 is attached to the first end 610 of the displacement rod 128 by a gimbal mount 708 that supports rotational motion of the tilt pad bearing 704 as the angle of the slip face 706 with respect to the axis of the displacement rod 128 changes with rotation of, and tilt angle adjustment of, the wobble plate 120. The tilt pad bearing 704 has a spherical internal surface 710 that applies the off-axis force transmitted from the wobble plate 120 through the tilt pad bearing 704 to the first end 610 of the displacement rod 128, which transmits the axial component of the off-axis force to the fluid end (not shown) and absorbs at least a portion of the off-axis component of the off-axis force in shear.

The gimbal mount 708 comprises a ring 712 that is rotatably attached to the first end 610 of the displacement rod 128 at a gimbal attachment location 714 spaced apart from the spherical end cap 702. There are two gimbal attachment locations 714 for each ring 712, located on opposite sides of the displacement rod 128. The two gimbal attachment locations 714 for each ring 712 define a rotational axis that is substantially perpendicular to a radius of the wobble plate 120 drawn to intersect the axis of the displacement rod 128. Thus, as the wobble plate 120 rotates, each tilt pad bearing 704 tilts toward the drive shaft 116 and away from the drive shaft 116. The tilt pad bearing 704 is attached to the ring 712 at ring attachment locations 716 that are angularly displaced from the gimbal attachment locations 714 by an angle of 90°. Each tilt pad bearing 704 has two fingers 718 on opposite sides of the tilt pad bearing 704.

The fingers 718 rotatably attach to the ring 712 on opposite sides thereof. In this way, the tilt pad bearing 704 is allowed two perpendicular axes of rotation to maintain contact with the first surface 130 of the wobble plate 120 during power and suction phases of the wobble plate rotation. Lubricity of the slip face 706 and the internal surface 710 is maintained by lubricant provided through a lubricant port 720 in a side 722 of the tilt pad bearing 704. The lubricant port 720 fluidly communicates with an interior plenum 724 of the tilt pad bearing 704. The interior plenum 724 further fluidly communicates with the slip face 706 through one or more ports (not shown) formed in a bearing surface 726 of the tilt pad bearing 704.

Figure 7B:
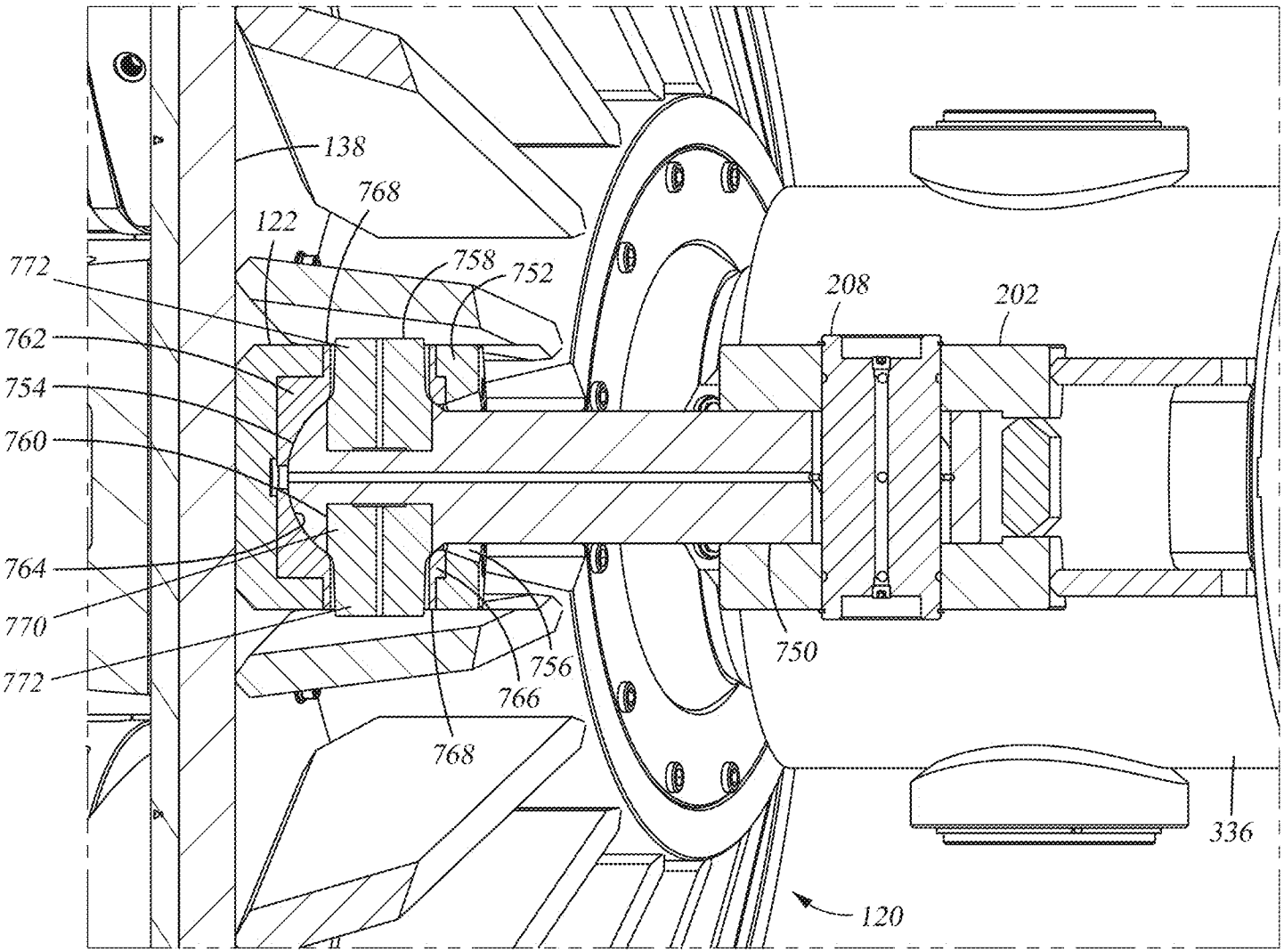
FIG. 7B is a cross-sectional view of the portion shown in FIG. 7A taken along a different section plane.

FIG. 7B is a cross-sectional view of the portion of the pump shown in FIG. 7A but taken along a different section plane. Specifically, the section plane of FIG. 7B is perpendicular to the section plane of FIG. 7A, and the section plane is taken through a portion of the thruster assembly 122 to show how the thruster assembly 122 interacts with the wobble plate 120. The thruster assembly 122 includes a thrust rod 750 coupled to the axle block 202 by the axle 208, as described above in connection with FIG. 2. The thrust rod 750 extends from the axle block 202 to a thrust block 752 that is coupled to the second surface 138 of the wobble plate 120. The thrust rod 750 has a spherical thrust end 754 that is disposed within the thrust block 752 through an opening 756 therein. The opening 756 has a tapered profile to accommodate non-axial movement of the thrust rod 750 within the opening 756. The opening 756 has a minimum inner radius that is less than a maximum outer radius of the thrust end 754, so the thrust rod 750 is captured within the thrust block 752.

A thrust axle 758 is disposed within a passage 760 formed through the thrust end 754. The thrust block 752 includes a thrust bearing 762 with a spherical slip face 764 that contacts the spherical thrust end 754 of the thrust rod 750. A collar ring 766 is disposed within the thrust block 752 adjacent to the opening 756 to provide a smooth contact surface for the thrust rod 750 and to prevent direct contact between the thrust rod 750 and the edges of the opening 756. The thrust bearing 762 and collar ring 766 together define a pair of axle openings 768 formed at opposite sides of the thrust block 752. The thrust axle 758 extends outward from the thrust end 754 into and through the axle openings 768. Here, each end of the thrust axle 758 protrudes slightly beyond the sides of the thrust block 752, but any convenient extent can be used. Transverse movement of the thrust rod 750 within the thrust block 752 is constrained by the collar ring 766.

The thrust axle 758 has a central portion 770 and two end portions 772. The central portion 770 is cylindrical to match the cylindrical inner profile of the passage 760. Each edge portion 772 is tapered in a frustoconical shape. Here, a small curvature radius joins the central portion 770 with each end portion 772. The tapered end portions 772 provide a tolerance for non-axial rotation of the thrust axle 758. The non-axial rotation of the thrust axle 758 provides some freedom to absorb and limit yaw movement of the wobble plate 120, but controls such motion within the confines of the axle openings 768. The thrust axle 758, the collar ring 766 and the thrust bearing 762 thus form a yaw limit assembly that limits yaw movement of the wobble plate 120.

Figure 8:
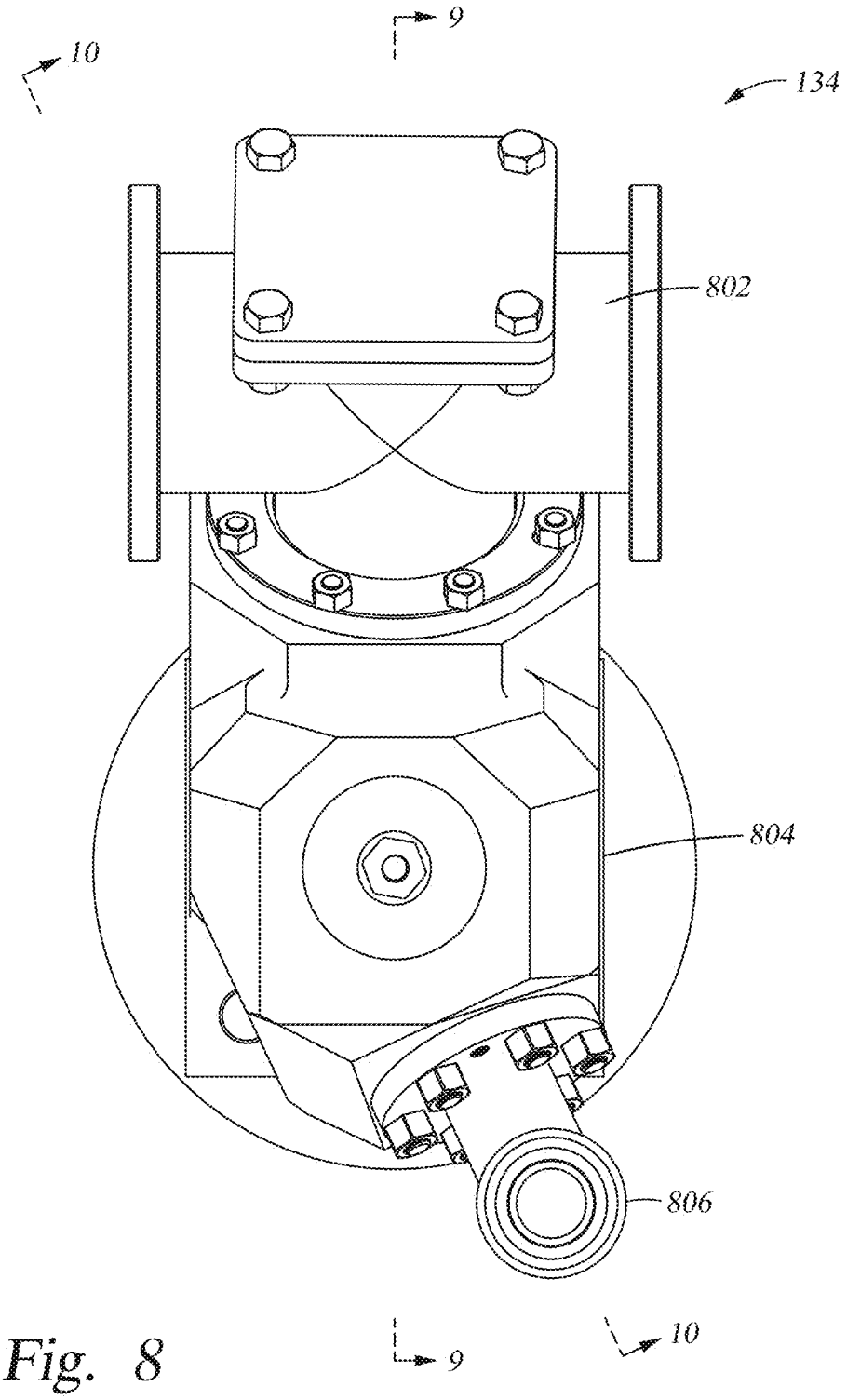
FIG. 8 is a plan view of a valve assembly of the pump of FIG. 1.

FIG. 8 is a plan view of a module assembly 134 of the pump of FIG. 1. The module assembly 134 has a suction portion 802 with a suction valve inside and a discharge portion 804 with a discharge valve in side. A discharge conduit 806 fluidly couples the discharge portion 804 with the discharge manifold (FIG. 1). The discharge portion 804, in this case, is not located in the same plane as the suction portion 802 and the discharge portion 804 due to space constraints at the fluid end 132 of the pump 100 (see FIG. 1). The discharge portion 804 is situated coaxially with a corresponding displacement rod 128 (not shown) such that the corresponding displacement member 624 can pressurize fluid through the discharge valve into the discharge portion 804.

Figure 9:
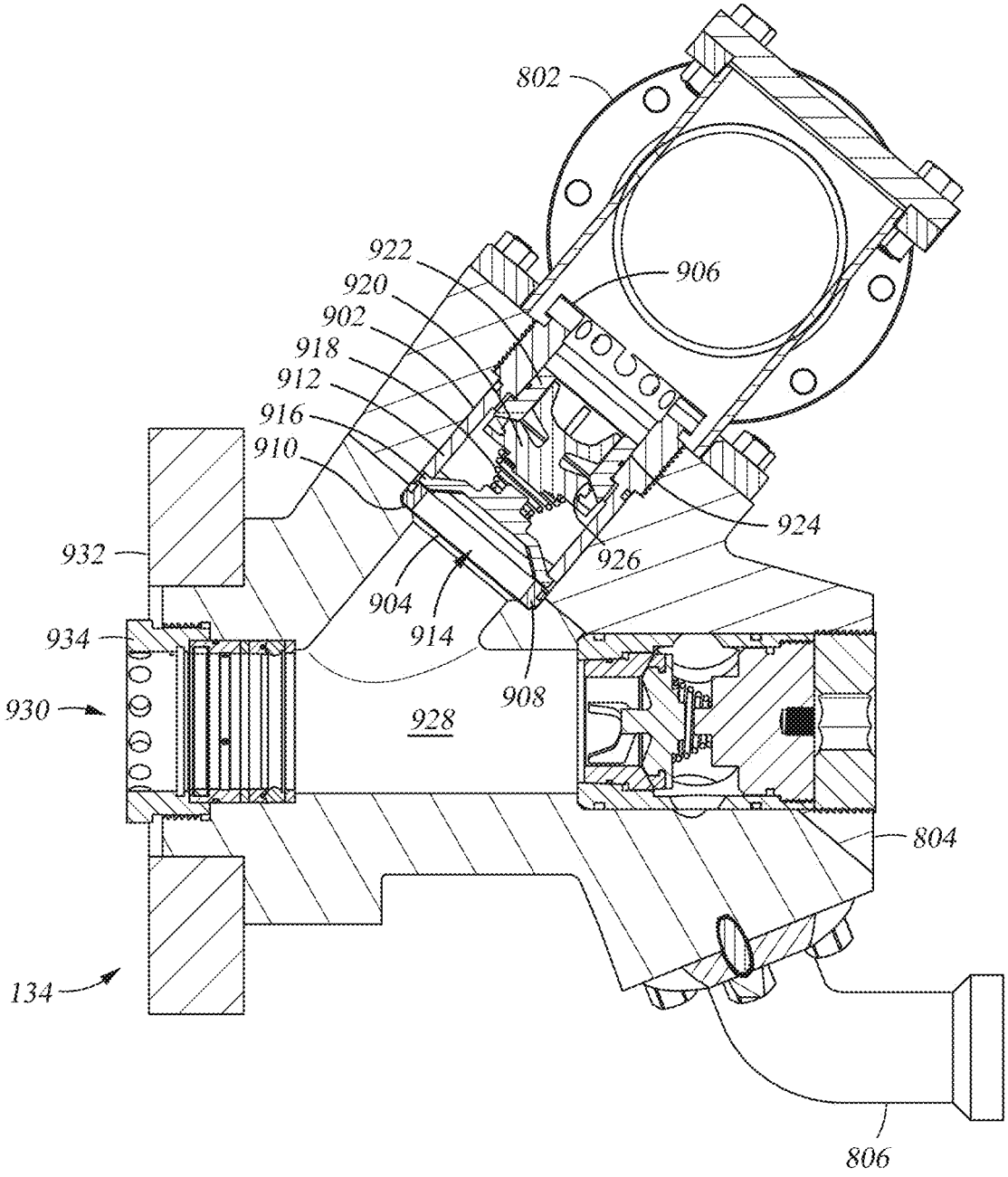
FIG. 9 is a cross-section of the valve assembly of FIG. 8 taken through a suction valve thereof.

FIG. 9 is a cross-section of the valve assembly of FIG. 8 taken through a suction valve thereof. A suction valve cartridge 902 is disposed in the suction portion 802. The suction valve cartridge 902 has a first end 904 and a second end 906 opposite the first end 904. The first end 904 has a seat ring 908 that seats within a recess 910 of the suction portion 802. The seat ring 908 is sealed against the wall of the recess 910 and is located at the deepest part of the recess 910 against the end thereof. The suction valve cartridge 902 has a side wall 912 with substantially straight sides extending from the seat ring 908. The side wall 912 generally encloses a suction valve structure 914. The suction valve structure 914 includes a valve retainer 916, a spring 918, and a valve body 920. A valve seat 922 is disposed in the suction valve cartridge 902 at the second end 906 thereof against a tapered valve seat surface 924 of the suction valve cartridge 902. The valve seat 922 has a valve closure surface 926 that is tapered to provide tight closure of the valve body 920 against the valve seat 922. The valve spring 918 is disposed between a back surface of the valve body 920 and the valve retainer 916.

The suction valve cartridge 902 is a single piece structure that is removable from the recess 910. In this case, the suction valve cartridge 902 couples to the suction portion 802 by threading into the recess 910, thus enabling easy removal of the suction valve cartridge 902 from the recess. The suction valve cartridge 902 can be disassembled by decoupling the seat ring 908 from the side wall 912. The valve retainer 916 can then be removed at the first end 904, followed by the valve spring 918, valve body 920, and valve seat 922. The modular assembly and disassembly of the suction valve cartridge 902, and components thereof, enable easy replacement of all or parts of the suction valve cartridge 902.

A suction manifold (not shown) is typically attached to the suction portion 802 near the second end 906 of the suction valve cartridge 902 to supply fluid for pumping. The valve body 920 disengages from the valve closure surface 926 to release fluid from the suction manifold into an interior plenum 928 of the module assembly 134. A plunger port 930 is located in an attachment end 932 of the module assembly 134. A plunger fitting 934 couples into the plunger port 930 to provide smooth travel of the plunger 624 (FIG. 6) into and out of the plunger port 930. As noted above, extension of the plunger into the plunger port 930 pressurizes fluid in the plenum 928 through the discharge portion 804 of the module assembly 134 into the discharge conduit 806.

Figure 10:
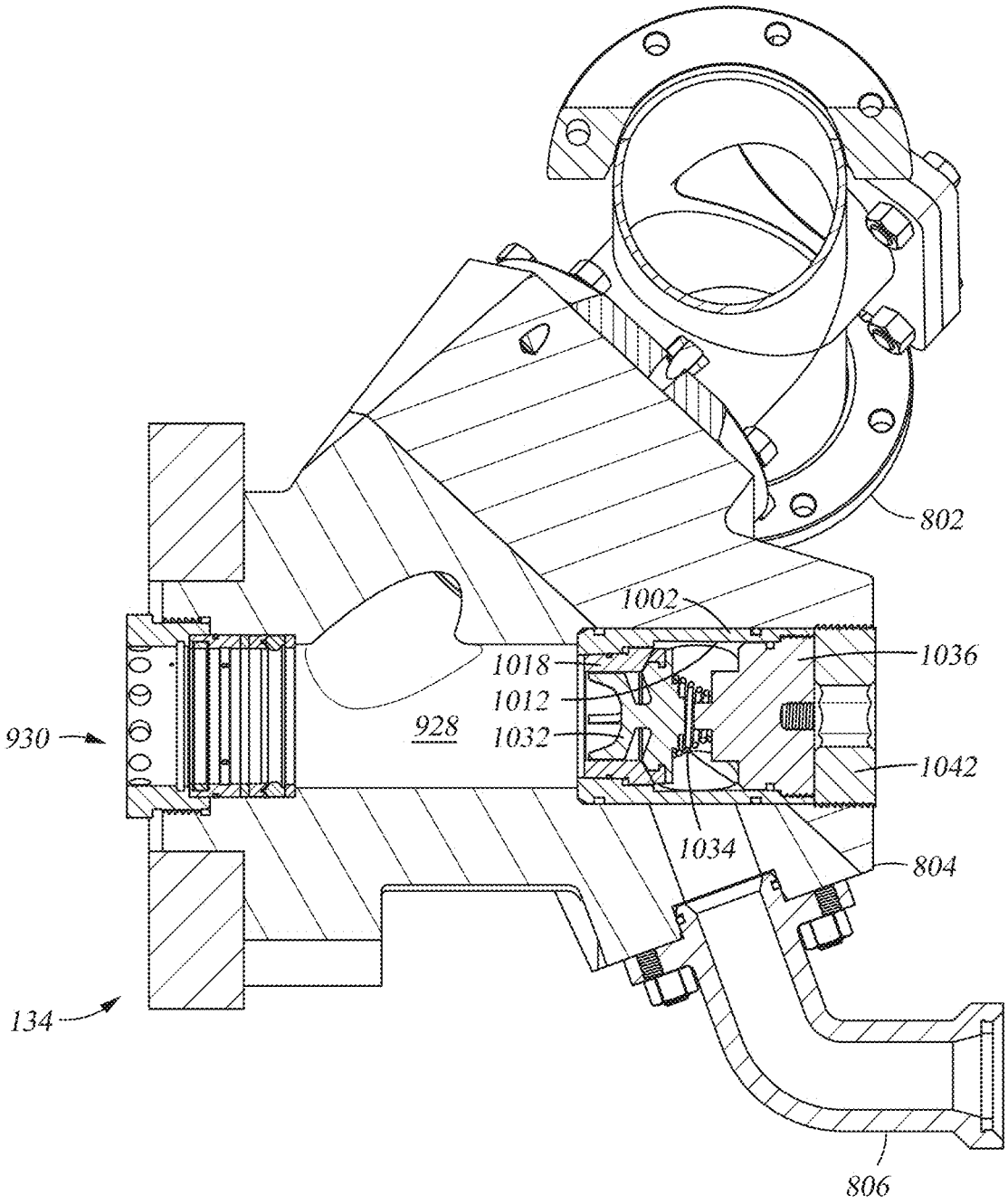
FIG. 10 is a different cross-section of the valve assembly of FIG. 8 taken through a discharge valve thereof.
Figure 11:
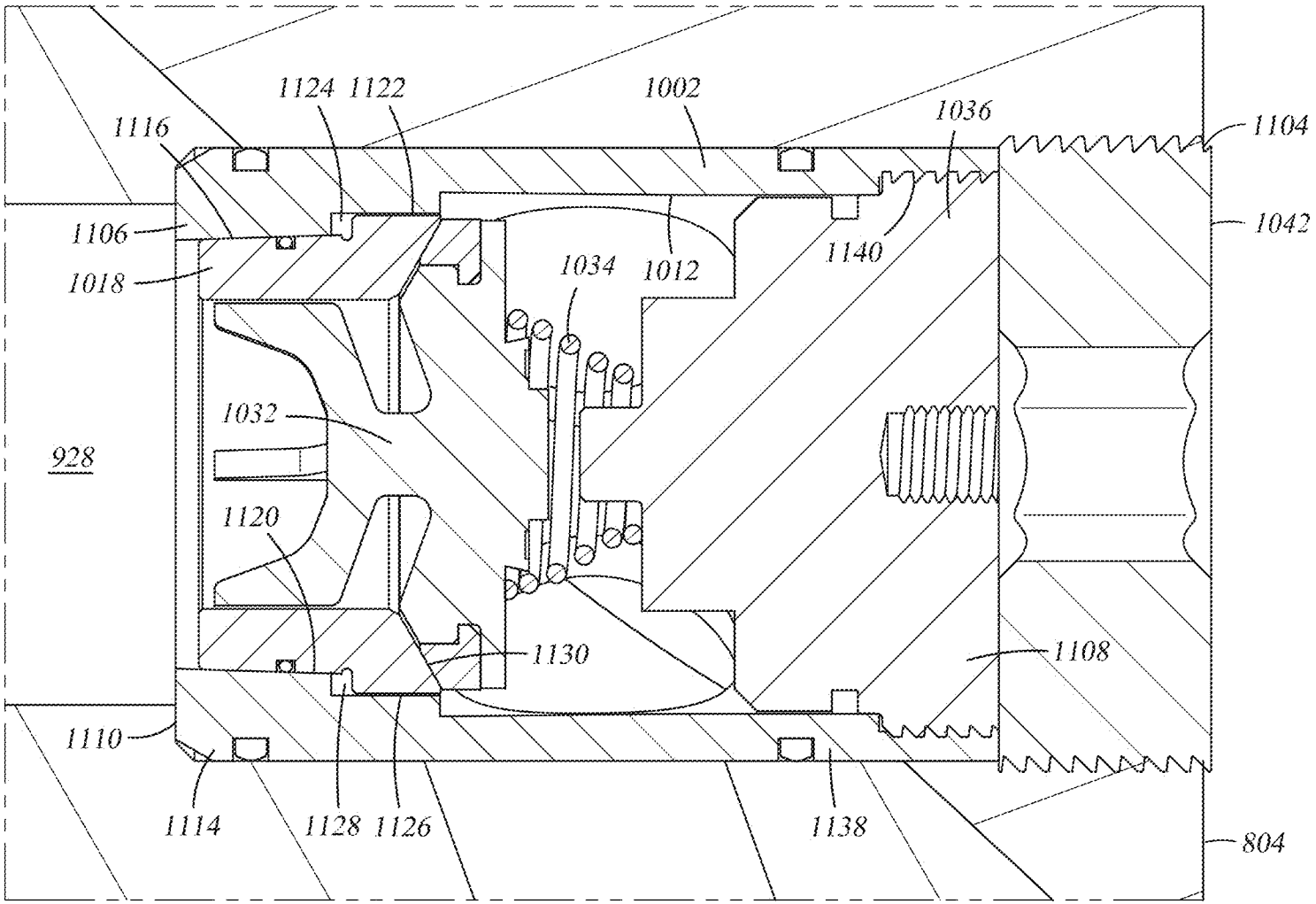
FIG. 11 is a close-up view of the cross-section of FIG. 10.

FIG. 10 is a different cross-section of the valve assembly of FIG. 8 taken through a discharge valve thereof. A discharge valve cartridge 1002 is disposed in a recess 1104 (FIG. 11) of the discharge portion 804. FIG. 11 is a close-up view of the cross-section of FIG. 10 focusing on the discharge valve cartridge 1002. The components shown in FIGS. 10 and 11 will be discussed together for simplicity of explanation. The discharge valve cartridge 1002 has a first end 1106 and a second end 1108 opposite the first end 1106. The first end 1106 seats in the deepest part of the recess 1104 against a flat ledge 1110 of the recess 1104. The discharge valve cartridge 1002 has a sidewall 1012 that has a generally increasing inner radius from the first end 1106 to the second end 1108. A first section 1114 of the sidewall 1012 has a tapered inner surface 1116 to receive a valve seat 1018 with a similarly tapered outer surface 1120. A second section 1122 of the sidewall 1012 has an inner surface 1126 that is not tapered and has an inner radius larger than the inner radius of the first section 1114. The first and second sections 1114 and 1122 meet at a ledge 1124. The valve seat 1018 has a flange 1126 that extends radially beyond the outer surface 1120 to form a shoulder 1128 between the flange 1126 and the outer surface 1120 that engages with the ledge 1124 to provide support for the valve seat 1018. The flange 1126 has an inwardly tapered surface 1130 that provides a seating surface for a valve body 1032. The sidewall 1012 has a third section 1138 with an inner surface that is not tapered and has an inner radius larger than the inner radius of the second section 1122. The third section 1138 generally accommodates the valve body 1032 and other moving valve structures in an interior of the discharge valve cartridge 1002. A fourth section 1140 of the sidewall 1012 is threaded and has an inner radius larger than the inner radius of the third section 1138.

A valve spring 1034 is disposed between a back surface of the valve body 1032 and a valve retainer 1036. The valve retainer 1036 is threaded to engage with the threaded fourth section 1140 of the discharge valve cartridge 1002. The discharge valve cartridge 1002 is removable as a unit, enabling easy replacement of the discharge valve cartridge 1002 in the module assembly 134. Removing the valve retainer 1036 allows for installation and removal of the valve seat 1018, the valve body 1032 and the valve spring 1034. The valve spring 1034 biases the valve body 1032 against the valve seat 1018, with compression provided by the valve retainer 1036 when installed. The discharge valve cartridge 1002 is secured within the recess 1104 of the discharge portion 804 by a retention plate 1042, which in this case threads into the discharge portion 804 to close the recess 1104 and is fastened to the valve retainer 1036 by a fastener.

When the plunger 624 (FIG. 6) extends into the plunger portal 930 fluid in the plenum 928 is pressured against the valve body 1032. When the fluid pressure overcomes the force of the valve spring 1034, the valve body 1032 disengages from the valve seat 1018 and the discharge valve opens. Fluid flows through the discharge valve and through an opening in the sidewall 1012 to the discharge conduit 806 to exit the module assembly 134. When extension of the plunger 624 ceases, pressure in the fluid decreases and the force of the valve spring 1034 reseats the valve body 1032 against the valve seat 1018 such that fluid does not flow through the discharge valve during the suction stroke of the plunger.

The pump 100 is a variable stroke pump. Operation of the tilt linkage described herein adjusts the tilt angle of the wobble plate. Tilt angle adjustment can be performed when the pump 100 is idle or when the pump is operating. For example, while the pump 100 is operating, wobble plate tilt angle can be set to zero to place the pump 100 in a standby mode. While in standby mode, the drive shaft is still turning, so the pump 100 can operate at zero displacement. When the tilt angle is changed to a positive non-zero value, the pump 100 begins producing displacement in relation to the tilt angle of the wobble plate. The pump 100 can operate continuously as the tilt angle is adjusted from zero to a maximum, so displacement of the pump 100 can be continuously and dynamically varied from zero to a maximum. This enables temporary idling of the pump 100 when needed without completely shutting the pump off. This also enables gradual ramping up of pump displacement to avoid disruptive startup and shutdown of the pump 100. In this way, adjustment of the tilt actuator changes stroke length of the pump, so pump flow rate can be continuously adjusted with constant drive input. Controls can be operatively coupled to the hydraulic source (or other actuator type) that adjusts the tilt angle to provide easy adjustment of pump operation. The reciprocating displacement operation of the pump 100 allows pumping of slurries, compressible fluids, and incompressible fluids. The pump 100 can, for example, be readily used as a fracturing pump.

While the foregoing is directed to embodiments of the invention, other and further embodiments of the invention may be devised without departing from the basic scope thereof.

What is claimed is:

1. A pump, comprising:

a drive shaft coupled to a drive;

a wobble plate attached to the drive shaft by a swivel mount;

a plurality of displacement rods, each having a first end and a second end, with the first end of each displacement rod disposed against a first surface of the wobble plate and the second end of each displacement rod connected with a plunger; and a tilt actuator assembly disposed around the drive shaft, the tilt actuator assembly comprising a slider having an interior surface with a slot formed therein and a thruster assembly coupled to the slider and extending toward a second surface of the wobble plate opposite the first surface, the tilt actuator assembly further comprising a key extending radially outward from the drive shaft and mated with the slot and a linear actuator slidably disposed against the slider.

2. The pump of claim 1, further comprising a tilt pad bearing between each displacement rod and the wobble plate.

3. The pump of claim 1, wherein the swivel mount is ball-shaped.

4. The pump of claim 3, wherein the swivel mount has a key slot parallel to the drive shaft, and a removable wobble plate key fits within the key slot.

5. The pump of claim 1, further comprising a frame with a base, a drive plate attached to the base, a fluid end plate attached to the base, and a bearing plate attached to the base between the drive plate and the fluid end plate, the bearing plate having a bore for each displacement rod.

6. The pump of claim 1, wherein the slider is a crosshead attached to the drive shaft by a guide ring.

7. The pump of claim 1, wherein the linear actuator is coupled to a hydraulic member located at a fluid end of the pump.

8. The pump of claim 7, wherein the linear actuator is coupled to the hydraulic member by a rotary bearing comprising two thrust bearings and a coupling plate attached to an end of the linear actuator, the coupling plate extending between the two thrust bearings.

9. The pump of claim 1, wherein the thruster assembly comprises a yaw limit assembly for controlling yaw movement of the wobble plate.

10. The pump of claim 1, wherein operation of the tilt actuator assembly adjusts the stroke length of the pump.

11. The pump of claim 1, wherein operation of the tilt actuator assembly adjusts the pump flow rate with constant drive shaft input speed.

12. The pump of claim 1, wherein the pump is a hydraulic fracturing pump.

13. The pump of claim 1, wherein the pump is able to pump slurries, compressible fluids, and/or incompressible fluids.

14. The pump of claim 1, wherein the thruster assembly comprises a thrust rod that is coupled to the slider by an axle block.

15. The pump of claim 14, wherein the thrust rod extends from the axle block into a thrust block coupled to the second surface.

16. A pump, comprising:

a drive shaft coupled to a drive;

a wobble plate attached to the drive shaft by a ball-shaped swivel mount with a wobble plate key extending radially inward from the wobble plate to the swivel mount;

a plurality of displacement rods, each having a first end and a second end, with the first end of each displacement rod disposed against a first surface of the wobble plate and the second end of each displacement rod connected with a plunger;

a tilt pad bearing between each displacement rod and the wobble plate;

a tilt actuator assembly disposed around the drive shaft, the tilt actuator assembly comprising a slider with a slot formed therein and a thruster assembly coupled to the slider and extending toward a second surface of the wobble plate opposite the first surface; and a key extending radially outward from the drive shaft and mated with the slot.

17. The pump of claim 16, wherein the swivel mount has a key slot parallel to the drive shaft, and the wobble plate key is a removable member that fits within the key slot.

18. The pump of claim 16, wherein the tilt actuator assembly comprises a linear actuator disposed within the drive shaft and coupled to the slider.

19. The pump of claim 18, wherein the linear actuator is coupled to a hydraulic member located at a fluid end of the pump.

20. The pump of claim 19, wherein the hydraulic member comprises a hydraulic cylinder with a port for providing hydraulic fluid to the hydraulic cylinder.

21. The pump of claim 16, wherein the wobble plate further comprises a rim, a hub, and a webbing that extends from the hub to the rim.

22. The pump of claim 16, wherein the thruster assembly comprises a thrust rod that is coupled to the slider by an axle block, the thrust rod having a spherical end that extends into a thrust block coupled to the second surface through a tapered opening of the thrust block.

23. The pump of claim 22, wherein the thruster assembly further comprises a thrust axle disposed through the spherical end of the thrust rod.

24. A pump, comprising:

a drive shaft coupled to a drive;

a wobble plate attached to the drive shaft by a swivel mount with a wobble plate key extending radially inward from the wobble plate to the swivel mount;

a plurality of displacement rods, each having a first end and a second end, with the first end of each displacement rod disposed against a first surface of the wobble plate and the second end of each displacement rod connected with a plunger;

a tilt pad bearing between each displacement rod and the wobble plate;

a tilt actuator assembly disposed around the drive shaft, the tilt actuator assembly comprising a slider with an interior surface that has a slot formed therein and a thruster assembly coupled to an exterior surface of the slider and extending toward a second surface of the wobble plate opposite the first surface, the slider attached to the drive shaft by a guide ring;

a key extending radially outward from the drive shaft and the guide ring, and mated with the slot; and a linear actuator slidably disposed within the drive shaft and coupled to the slider and to a hydraulic member located at a fluid end of the pump.

25. The pump of claim 24, wherein the swivel mount has a key slot parallel to the drive shaft, and the wobble plate key is a removable member that fits within the key slot.

26. The pump of claim 24, wherein the thruster assembly comprises a thrust rod that is coupled to the slider by an axle block, the thrust rod having a spherical end that extends into a thrust block coupled to the second surface through a tapered opening of the thrust block, and a thrust axle disposed through the spherical end of the thrust rod, wherein the thrust block comprises a collar ring that engages with the thrust axle.

27. The pump of claim 26, wherein thrust block further comprises a thrust bearing that engages with the spherical end of the thrust rod, the thrust bearing and the collar ring together define a pair of axle openings in the thrust block on opposite sides of the spherical end, and the thrust axle extends through the axle openings.

* * * * *